US010443344B2

(12) United States Patent
Vasques et al.

(10) Patent No.: US 10,443,344 B2
(45) Date of Patent: Oct. 15, 2019

(54) DOWNHOLE VALVE SYSTEM

(71) Applicant: Welltec Oilfield Solutions AG, Zug (CH)

(72) Inventors: Ricardo Reves Vasques, Allerød (DK); Satish Kumar, Allerød (DK); Lars StÆhr, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 147 days.

(21) Appl. No.: 15/502,314

(22) PCT Filed: Aug. 7, 2015

(86) PCT No.: PCT/EP2015/068252
§ 371 (c)(1),
(2) Date: Feb. 7, 2017

(87) PCT Pub. No.: WO2016/020523
PCT Pub. Date: Feb. 11, 2016

(65) Prior Publication Data

US 2017/0234105 A1 Aug. 17, 2017

(30) Foreign Application Priority Data

Aug. 8, 2014 (EP) ..... 14180326

(51) Int. Cl.
*E21B 34/14* (2006.01)
*E21B 34/06* (2006.01)
(Continued)

(52) U.S. Cl.
CPC ..... *E21B 34/06* (2013.01); *E21B 23/02* (2013.01); *E21B 23/03* (2013.01); *E21B 34/14* (2013.01);
(Continued)

(58) Field of Classification Search
CPC ..... E21B 34/14; E21B 2034/007
See application file for complete search history.

(56) References Cited

U.S. PATENT DOCUMENTS 5,609,178 A * 3/1997 Hennig ..... E21B 23/006 137/10
2006/0124310 A1 6/2006 Lopez de Cardenas et al.
(Continued)

FOREIGN PATENT DOCUMENTS

GB 2 421 745 A 7/2006
GB 2 439 419 A 12/2007
(Continued)

OTHER PUBLICATIONS

International Search Report for PCT/EP2015/068252 dated Feb. 12, 2016, 4 pages.
(Continued)

*Primary Examiner* — Shane Bomar
(74) *Attorney, Agent, or Firm* — Nixon & Vanderhye P.C.

(57) ABSTRACT

The present invention relates to a downhole valve system (1) for controlling inflow of a fluid from and to a formation (100), comprising a casing (2) having an inner surface (3), an outer diameter ($OD_c$) and an inner diameter ($ID_c$), and a cross section ($A_c$) defined by the inner diameter, the casing comprising a plurality of valves (4, 4*a*, 4*b*, 4*c*) arranged spaced apart from each other for controlling the flow of the fluid to and from the formation through the casing, and a plurality of autonomous operating adjusting devices (5) each controlling one of the plurality of valves and each autonomous operating adjusting device comprising a body (6) having an outer body diameter ($D_b$) and a body cross section ($A_b$), the plurality of autonomous operating adjusting devices being fastened inside the casing in order to allow the fluid to flow between the outer body diameter of the body of the autonomous operating adjusting device and the casing.
(Continued)

The present invention furthermore relates to a method for controlling an inflow of fluid by controlling a plurality of valves in a downhole valve system according to the present invention.

17 Claims, 11 Drawing Sheets

(51) Int. Cl.

| | |
|---|---|
| ***E21B 23/02*** | (2006.01) |
| ***E21B 23/03*** | (2006.01) |
| ***E21B 41/00*** | (2006.01) |
| ***E21B 43/12*** | (2006.01) |
| ***E21B 43/14*** | (2006.01) |
| ***E21B 47/06*** | (2012.01) |
| ***E21B 47/10*** | (2012.01) |
| ***E21B 47/18*** | (2012.01) |
| ***E21B 49/08*** | (2006.01) |
| *E21B 23/01* | (2006.01) |
| *E21B 43/26* | (2006.01) |
| *E21B 34/00* | (2006.01) |

(52) U.S. Cl.
CPC ..... *E21B 41/00* (2013.01); *E21B 43/12* (2013.01); *E21B 43/14* (2013.01); *E21B 47/06* (2013.01); *E21B 47/065* (2013.01); *E21B 47/10* (2013.01); *E21B 47/18* (2013.01); *E21B 49/08* (2013.01); *E21B 23/01* (2013.01); *E21B 43/26* (2013.01); *E21B 2034/007* (2013.01)

(56) References Cited

U.S. PATENT DOCUMENTS

2009/0065199 A1 3/2009 Patel et al.
2011/0191028 A1* 8/2011 Ross ..... E21B 47/01 702/6
2011/0240311 A1* 10/2011 Robison ..... E21B 23/04 166/373
2011/0284240 A1 11/2011 Chen et al.
2012/0085538 A1* 4/2012 Guerrero ..... E21B 33/12 166/284
2013/0062063 A1* 3/2013 Baihly ..... E21B 23/04 166/297
2014/0076542 A1* 3/2014 Whitsitt ..... E21B 34/14 166/250.1
2015/0361761 A1* 12/2015 Lafferty ..... E21B 23/14 166/250.01
2015/0369023 A1* 12/2015 MacPhail ..... E21B 43/12 166/269
2016/0040515 A1* 2/2016 Yeh ..... E21B 43/08 166/373
2017/0218725 A1* 8/2017 Schnell ..... E21B 34/14
2018/0347312 A1* 12/2018 Green ..... E21B 43/12

FOREIGN PATENT DOCUMENTS

RU 2 310 066 C2 7/2007
RU 2 441 981 C2 12/2008
WO WO 2014/065813 5/2014

OTHER PUBLICATIONS

Written Opinion of the ISA for PCT/EP2015/068252 dated Feb. 12, 2016, 5 pages.
Extended European Search Report for 14180326.2 dated Feb. 17, 2015, 7 pages.
Notification of the First Office Action dated Sep. 25, 2018 in Chinese Application No. 201580041392.9, with English translation, 18 pages.
Zhang, Shaodong, "The Progresses in Domestic and Foreign Petroleum Technology and the Geology and Exploitation in the Eleventh Five-Year Plan: the Exploitaiton of Marginal Oilfield," China Petrochemical Press, Beijing, Jun. 30, 2013, p. 257, with English translation.
Office Action of Substantive Examination dated Mar. 11, 2019 in Russian Application No. 2017105856/03(010390), with English translation, 11 pages.

* cited by examiner

DOWNHOLE VALVE SYSTEM

This application is the U.S. national phase of International Application No. PCT/EP2015/068252 filed Aug. 7, 2015 which designated the U.S. and claims priority to EP Patent Application No. 14180326.2 filed Aug. 8, 2014, the entire contents of each of which are hereby incorporated by reference.

FIELD OF THE INVENTION

The present invention relates to a downhole valve system and a method for controlling inflow or injection of a fluid to and from a formation.

BACKGROUND ART

Valves may be controlled in many ways. Casings comprising means for controlling valves in a well are often referred to as intelligent completions. Conventional intelligent completion makes use of control lines, most often kilometers of hydraulic and/or electrical control lines. These control lines are expensive and frequently malfunctioning due to faulty connections or control line damage. Damaged control lines are practically impossible to repair or replace as they are arranged outside the production casing. Furthermore, the parts constituting the intelligence necessarily take up space, resulting in a smaller casing diameter than in non-intelligent completions having no such control lines. Decreasing the casing diameter reduces the cross-sectional area of the aperture, i.e. the area where e.g. the fluid flows. Hence, casings of intelligent completions typically have a significantly reduced cross-sectional area of the flow area compared to conventional completions. Often, the flow area, i.e. the aperture, is reduced by 65% or more. Consequently, the maximum flow of fluid is significantly reduced compared to more conventional wells, and hence, the overall profitability of the well may be compromised.

SUMMARY OF THE INVENTION

It is an object of the present invention to wholly or partly overcome the above disadvantages and drawbacks of the prior art. More specifically, it is an object to provide an improved system for controlling the flow to and from a well that causes less reduction in the flow of fluid in the casing and/or does not fail as much as the intelligent completions with control lines.

The above objects, together with numerous other objects, advantages and features, which will become evident from the below description, are accomplished by a solution in accordance with the present invention by a downhole valve system for controlling flow of a fluid to and from a formation, comprising:

- a casing having an inner surface, an outer diameter and an inner diameter, and a cross section defined by the inner diameter, the casing comprising:
  - a plurality of valves arranged spaced apart from each other for controlling the flow of the fluid to and from the formation through the casing, and
- a plurality of autonomous operating adjusting devices each controlling one of the plurality of valves and each autonomous operating adjusting device comprising a body having an outer body diameter and having a body cross section, the plurality of autonomous operating adjusting devices being fastened inside the casing in order to allow the fluid to flow between the outer body diameter of the body of the autonomous operating adjusting device and the casing.

In this way, it is achieved that the downhole valve system may control the flow in a way with a minimum of restraints in terms of reaction time to changing the inflow from the formation. This is because it is possible to keep the autonomous operating adjusting devices for controlling a valve in the casing. The autonomous operating adjusting devices do not need to be drawn to the surface after use. This is possible due to fact that each autonomous operating adjusting device restricts the flow of fluid less than a casing comprising similar controlling means. Hence, the autonomous operating adjusting device simply rests in the well inside the casing until it will be used again. When positioning an autonomous operating adjusting device for controlling a valve providing the controlling of the inflow inside the casing, it is possible to use a maximum diameter of the casing. In such a system, the casing does not need to be reduced to provide volume to contain any of the parts for controlling the valve, but still, the system is considered an intelligent system. The physical parts required to provide the controlling necessarily need to be contained in a volume, i.e. in the body of each autonomous operating adjusting device. However, the cross section of the body of each autonomous operating adjusting device restricts the cross section less than if the controlling means were to be enclosed in the wall of the casing. Traditional build-up of the controlling means, e.g. when contained in the casing, causes the cross section to be reduced from the periphery of the inner diameter towards the centre of the casing. However, when such a reduction extends along the full periphery of the casing, it causes a greater reduction in the total cross-sectional area than if the same part were positioned in the centre of the casing. Furthermore, the use of an autonomous operating adjusting device enhances service ability and eliminates the need for control lines.

When the autonomous operating adjusting devices have been positioned in the casing, a number of possible adjustment possibilities are obtained. The flow of fluid from the formation is controlled by adjusting the flow from each of the valves. The valves may be arranged in different production zones, and hence, it is possible to adjust the mixture of the fluid in order to achieve the desired properties, e.g. in relation to lifting the well or in relation to the subsequent processing of the fluid. By positioning the intelligent controlling means of the casing or valve in an autonomous operating adjusting device, it is possible to decide how the fluid should pass the body required to contain the intelligence.

Hence, since each valve of the system is provided with a means for controlling the valves, it is not necessary to use e.g. wireline tools to change the flow through a valve. Hence, the system provides faster response to changes in the flow of fluid. Therefore, the well may at all times be continuously optimised to the desired quality of the fluid. The system may be a telemetry system.

Furthermore, during injection of fluid to the formation, e.g. during hydraulic fracking, the controlling of the injection is improved, similar to the situation of controlling flow from the formation.

Furthermore, due to the body of the autonomous operating adjusting device having a small cross-sectional area, the cross-sectional passageway in parts of casings comprising valves is increased compared to the known intelligent completions. This is achieved because the parts are arranged near the centre of the casing instead of being enclosed in the casing.

The cross section of the body of the autonomous operating adjusting device may be less than 50% of the cross section of the casing defined by the inner diameter, preferably less than 40%, and more preferably less than 30%.

In this way, it is achieved that a greater flow of fluid is possible as compared to traditional intelligent valves and casings. Equipment for controlling the valve in an intelligent completion is arranged outside the production casing and thus the diameter of the production casing is made substantially smaller to give room for the equipment than in non-intelligent completions of the same borehole. In the present invention, the greater area, and thus the greater flow, is obtained in that the volume occupied by equipment for controlling the valve is contained inside the casing in a space confined by e.g. a cylinder instead of the volume surrounding the casing. Thus, the room/space occupied by equipment for operating the valves is substantially smaller in the present invention than in the intelligent completion because the casing is not decreased in diameter. The increased flow of fluid is advantageous because it provides more options for adjusting the well to a desired production.

In an embodiment, each valve may have a profile.

Furthermore, each valve may have a sliding sleeve having a profile.

In addition, the profile may be a grove or grooves in the valve or sliding sleeve of the valve.

Also, the profile may be a magnetic material of the valve.

Moreover, the autonomous operating adjusting device may comprise an operating means, such as a key, configured to engage the profile.

Further, the operating means may be projectable from the body to engage a matching profile of the valve.

Additionally, the operating means may be projected from the body by means of mechanical power, such as a spring.

By being mechanically powered, the autonomous operating adjusting device can be permanently installed in the casing to operate the valve.

Furthermore, the operating means may be retracted by means of hydraulics or electricity.

Also, the operating means may be an anchoring means.

In addition, each autonomous operating adjusting device may engage an inner face of the valve and/or the casing by at least two locations along the circumference of the valve and/or the casing.

Moreover, the body of the autonomous operating adjusting device may be arranged concentrically with the casing.

Also, the body of the autonomous operating adjusting device may be arranged eccentrically from a central axis of the inner diameter of the casing.

Further, the body of the autonomous operating adjusting device may abut the inner surface of the casing.

The system as described above may comprise a sensor for measuring a condition of the fluid, such as the temperature, pressure, water out, density or flow rate.

Additionally, a sensor may be arranged in each autonomous operating adjusting device.

Furthermore, the sensor may be arranged in the casing.

Moreover, the sensor may comprise a communication means for communicating with the autonomous operating adjusting device.

Each autonomous operating adjusting device may comprise a processor for computing measured sensor data for controlling the valve.

Also, each autonomous operating adjusting device may operate wirelessly.

Further, each autonomous operating adjusting device may comprise a fishing neck.

In addition, each autonomous operating adjusting device may comprise a battery.

Moreover, each autonomous operating adjusting device may comprise a communication means.

In the downhole valve system as described above, the plurality of autonomous operating adjusting devices may be positioned in succession of each other in the casing.

Furthermore, each autonomous operating adjusting device may comprise a dispatching means for dispatching an information device.

Additionally, each autonomous operating adjusting device may comprise a pressure pulse communication means for receiving signals from surface and/or another autonomous operating adjusting device.

Also, each valve may comprise a displaceable part for adjusting the inflow of fluid.

Further, the displaceable part may comprise a sliding sleeve or a rotational sleeve.

Moreover, each autonomous operating adjusting device may comprise a positioning detection unit for determining the position of the displaceable part.

The positioning detection unit may comprise magnets.

Furthermore, each autonomous operating adjusting device may comprise an anchoring means for fastening the autonomous operating adjusting device in the casing.

Additionally, each autonomous operating adjusting device may comprise a releasing means for releasing the anchor means above a predetermined value of pulling force. The releasing means may be a shear pin or a shear disc.

Also, each autonomous operating adjusting device may comprise an operating means for operating the moveable part.

Further, the operating means may comprise a key.

Each operating means may comprise a stroking device providing an axial stroke for moving the displaceable part.

In the downhole valve system as described above, the valve may comprise a base part having at least one first marker.

Also, the displaceable part may comprise a second marker.

The present invention also relates to a method for controlling a flow of fluid by controlling a plurality of valves in a downhole valve system as described above, the method comprising the steps of:

- arranging each autonomous operating adjusting device opposite one of the valves,
- fastening the autonomous operating adjusting device to the inner surface of the casing,
- measuring a condition of the fluid, and
- controlling the valve based on the measured condition of the fluid.

The step of arranging each autonomous operating adjusting device may be performed by a deployment means such as a wireline or a downhole driving unit, and the method may further comprise the step of releasing the autonomous operating adjusting device from the deployment means.

Said method may further comprise the step of determining the position of the displaceable part in relation to a base part of the valve.

Finally, the method may further comprise the step of adjusting a position of the displaceable part of the valve.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
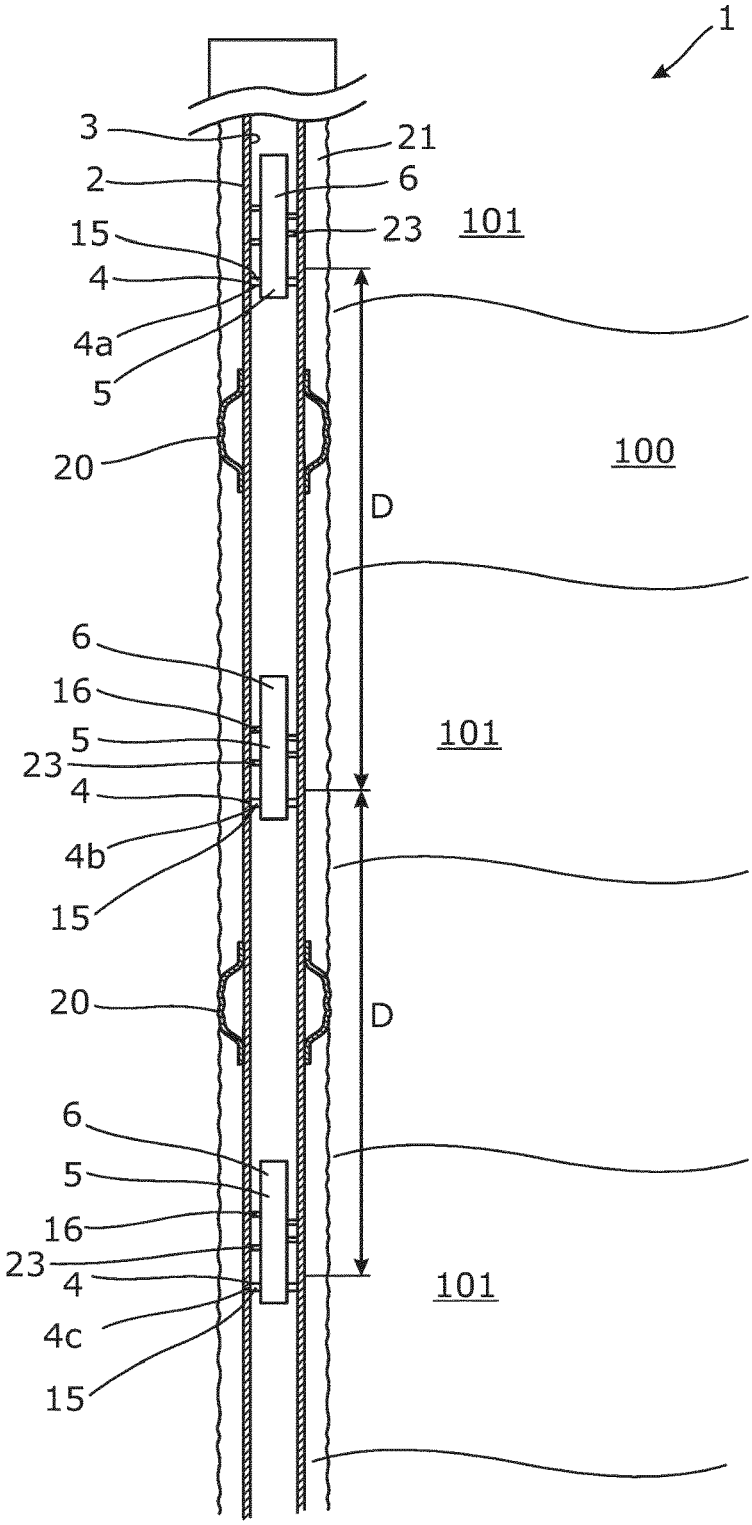
FIG. 1 shows a partly cross-sectional view of a downhole valve system for controlling the inflow of a fluid from several production zones in a formation.

FIG. 1 shows a downhole valve system 1 for controlling an inflow of a fluid from several production zones 101 in a formation 100. The system 1 comprises a casing 2 arranged in a borehole 21 and annular barriers 20 for isolating the production zones 101. The casing 2 comprises a plurality of valves 4, 4*a*, 4*b*, 4*c* arranged spaced apart from each other by distances for controlling the inflow of the fluid from the production zones 101 and into the casing. The system 1 further comprises a plurality of autonomous operating adjusting devices 5 each controlling one of the plurality of valves 4. Each autonomous operating adjusting device 5 comprises a body 6 having an outer body diameter $OD_b$ (shown in FIG. 2). The plurality of autonomous operating adjusting devices 5 are fastened to an inner surface 3 of the casing 2. The autonomous operating adjusting devices 5 are arranged in succession of each other in the casing 2 so that the lowest autonomous operating adjusting device 5 is first arranged opposite the valve 4*c*, and then, the next autonomous operating adjusting device 5 is arranged opposite valve 4*b*, and so forth. The autonomous operating adjusting devices 5 are permanently arranged in the casing for controlling one valve and are unable to pass another autonomous operating adjusting device 5. Each autonomous operating adjusting device 5 operates wirelessly and is not connected to surface after deployment.

Figure 2A:
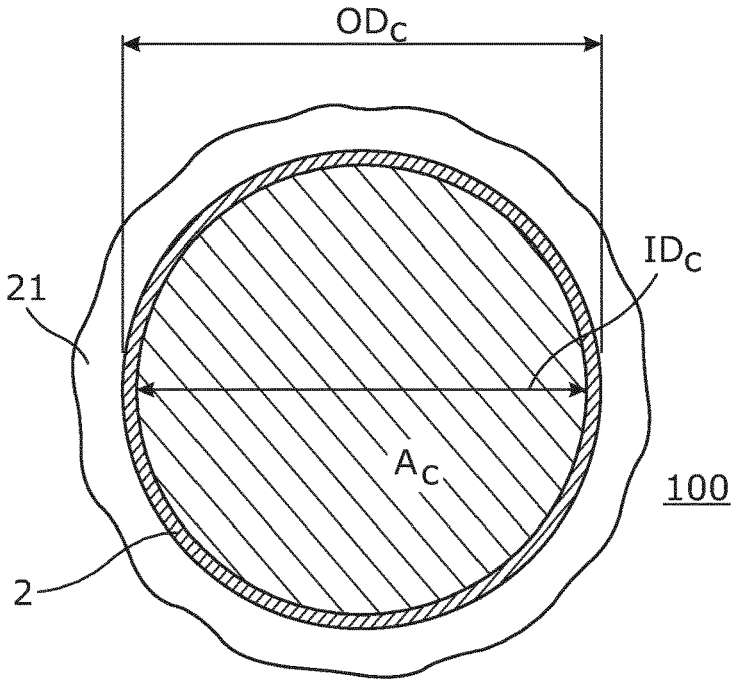
FIG. 2*a* shows a casing part without any autonomous operating adjusting devices arranged therein.
Figure 2B:
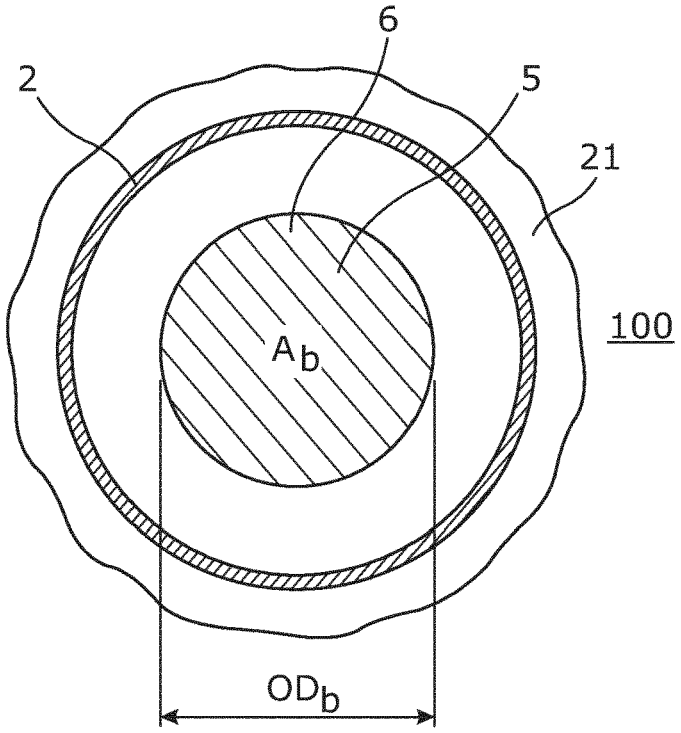
FIG. 2*b* shows a cross-sectional view of an autonomous operating adjusting device arranged in a casing.
Figure 6:
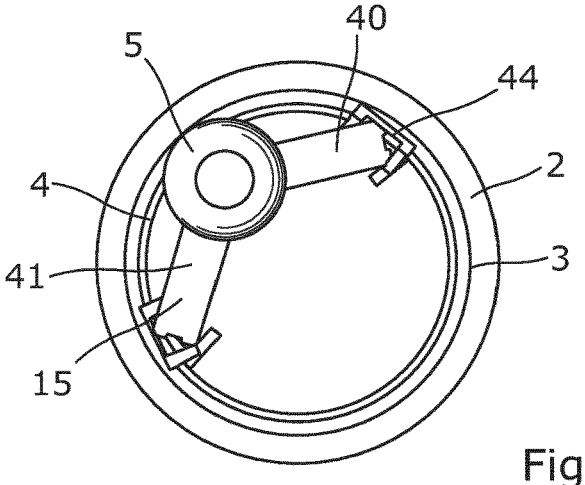
FIG. 6 shows a partly cross-sectional view of a casing with a valve having a displaceable part and an autonomous operating adjusting device arranged decentrically in the casing.

As can be seen in FIGS. 2*a* and 2*b*, the outer body diameter $OD_b$ of the autonomous operating adjusting device 5 is smaller than an inner diameter $ID_c$ of the casing 2, which allows the fluid to flow between the autonomous operating adjusting device and the casing. In FIG. 2*a*, the casing 2 has a cross section $A_c$ defined by the inner diameter $ID_c$, and in FIG. 2*b*, the body 6 has a body cross section $A_b$. The cross section of the body 6 of the autonomous operating adjusting device 5 is less than 50% of the cross section of the casing 2 defined by the inner diameter, and in another embodiment, preferably less than 40% and more preferably less than 30%. The flow area between the autonomous operating adjusting device 5 is thus more than 50% of the cross section of the casing 2. In known intelligent wells, the cross section of the casing is approximately 35% of the cross section $A_c$ of the casing shown in FIG. 2*a* because the control lines and other equipment for making the well intelligent occupy so much of the annulus between the borehole wall and the outer face of the casing. Thus, by inserting the autonomous operating adjusting device 5 of the present invention, the resulting flow area is much larger than in the known intelligent wells. Later on, e.g. after 5-10 years, the autonomous operating adjusting devices may be replaced by other autonomous operating adjusting devices. As can be seen, the body of the autonomous operating adjusting device is arranged concentrically with the casing. In FIG. 6, the body of the autonomous operating adjusting device is arranged eccentrically from a central axis of the inner diameter of the casing 2, and the body of the autonomous operating adjusting device abuts the inner surface of the casing.

Figure 3:
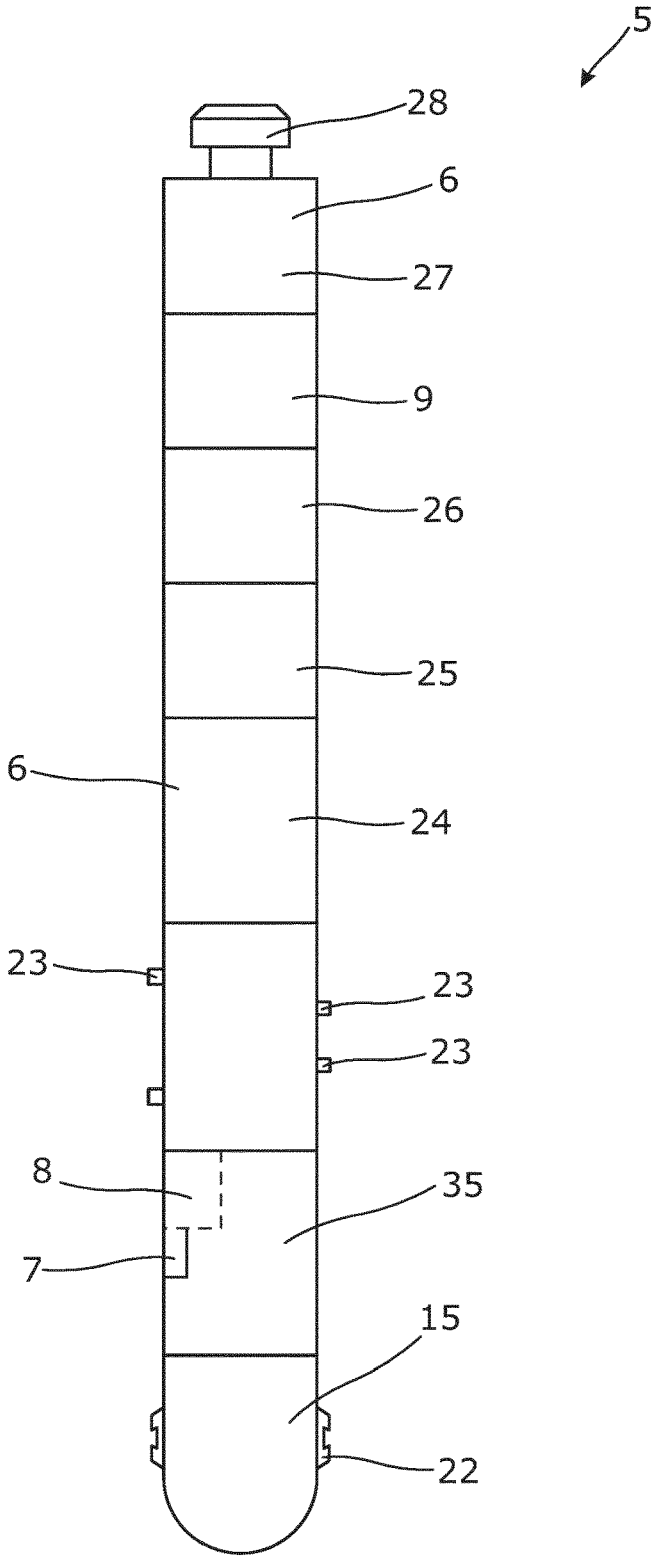
FIG. 3 shows an autonomous operating adjusting device.
Figure 10:
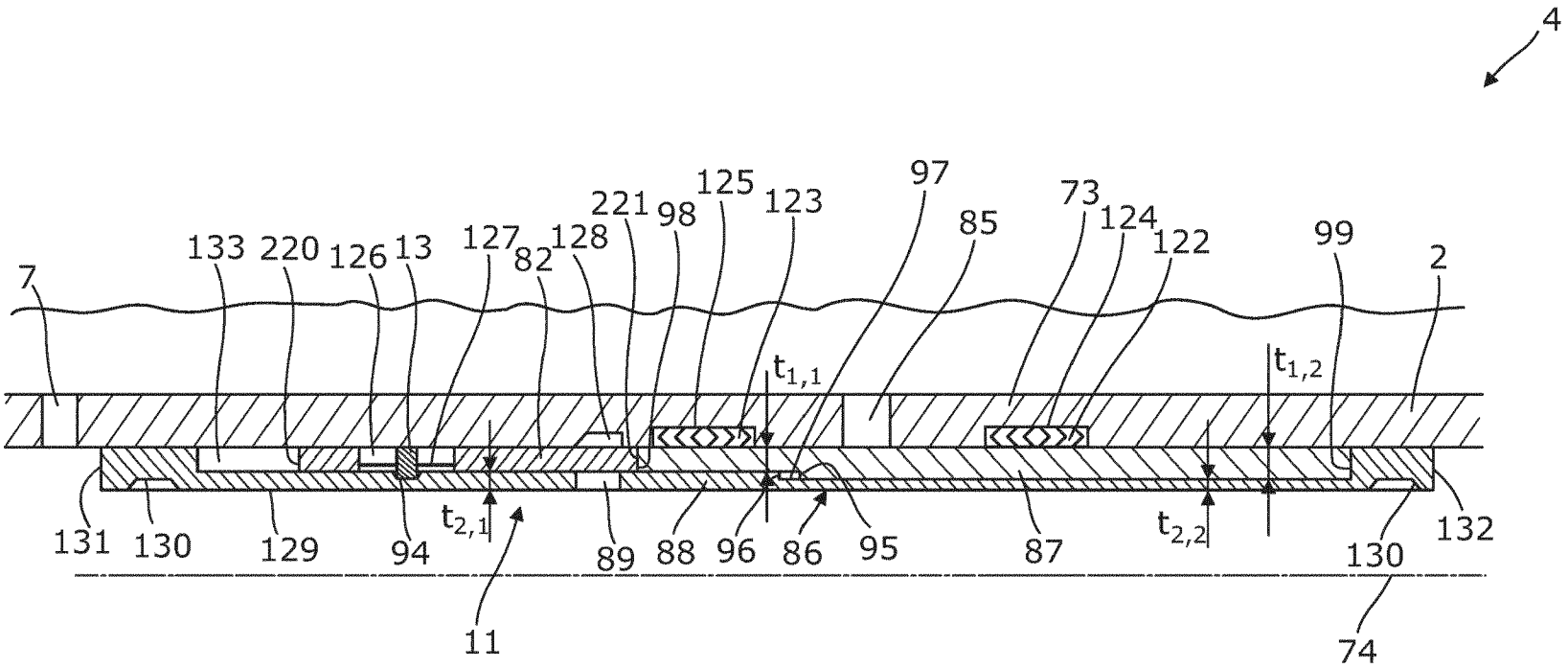
FIG. 10 shows a cross-sectional view of a valve in a closed position.

In FIG. 3, the autonomous operating adjusting device 5 comprises a sensor 7 for measuring a condition of the fluid, such as the temperature, pressure, water out, density or flow rate. In FIG. 10, the sensor 7 may be arranged in the casing 2. When deploying the autonomous operating adjusting device (not shown), the autonomous operating adjusting device may be preprogrammed with the conditions of the formation, such as the pressure or the temperature, and when the the condition of the fluid inside the casing changes too much in relation to the formation condition, the autonomous operating adjusting device 5 adjusts the valve to open or choke the inflow of fluid or even close the valve if the water cut has become too high. Each autonomous operating adjusting device comprises a processor 8 for computing measured sensor data for controlling the valve.

Each autonomous operating adjusting device comprises an anchoring means 23, as shown in FIG. 3, for fastening the autonomous operating adjusting device in the casing 2. In order to adjust the valve, the autonomous operating adjusting device 5 comprises an operating means 15, such as a key 22, which is projectable from the body 6 to engage a matching profile 45 (see FIG. 7) of the valve. The operating means is projected from the body by means of mechanical power, such as a spring. By being mechanically powered, the autonomous operating adjusting device can be permanently installed in the casing to operate the valve. The operating means is retracted by means of hydraulics or electricity, meaning that power is often required to retract the autonomous operating adjusting device, as the autonomous operating adjusting device may no longer have the power to disengage.

The valve comprises a displaceable part 14 (see FIG. 12), such as an axially sliding sleeve, for adjusting the inflow of fluid. The sliding sleeve is engaged by the operating means 15 when the autonomous operating adjusting device 5 has been fastened inside the casing 2, and then, a stroking device 24 provides an axial stroke to move the displaceable part. The stroking device is, in FIG. 3, operated by a pump 25 which is controlled by electronics 26 and powered by a battery 27. The autonomous operating adjusting device 5 further comprises a communication means 9 for communicating with surface, another autonomous operating adjusting device 5 and/or a valve (not shown). Thus, the sensor of the valve may comprise a communication means for communicating with the autonomous operating adjusting device. In order to retrieve the autonomous operating adjusting device 5, a fishing neck 28 is arranged in the top of the device.

Figure 4:
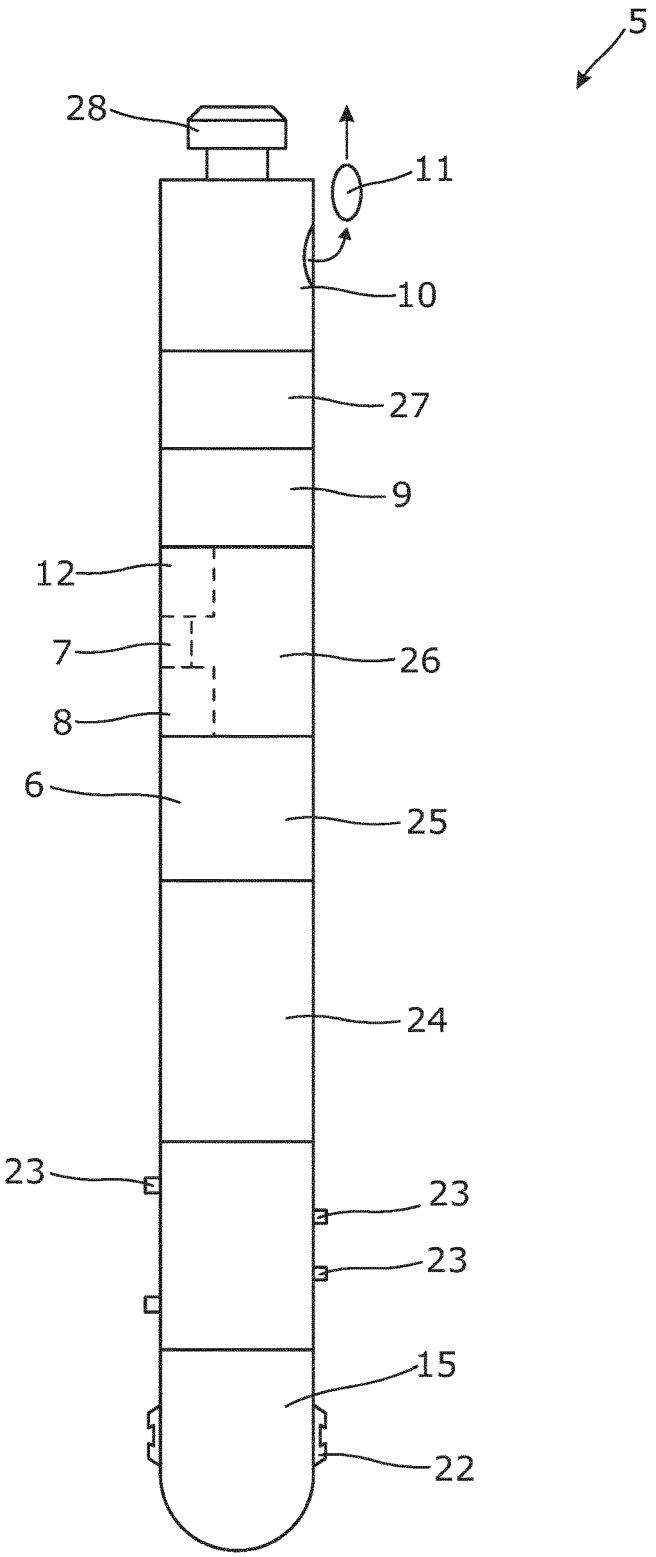
FIG. 4 shows another autonomous operating adjusting device.

In FIG. 4, the autonomous operating adjusting device 5 comprises a dispatching means 10 for dispatching an information device 11. The information device 11 may be dispatched when the valve has been adjusted or once a year with information of the sensor measured data and the adjustments of valve being made within that year.

The autonomous operating adjusting devices 5 comprise a communication means and are able to communicate with each other, e.g. if one autonomous operating adjusting device 5 has closed the valve it operates, an adjacent valve may need to be opened more. Furthermore, if the flow rate of the fluid decreases, it may be useful to open one of the valves producing more water to lift the more heavy part of the fluid.

As shown in FIG. 4, the autonomous operating adjusting device 5 further comprises a pressure pulse communication means 12 for receiving or sending signals to/from surface and/or another autonomous operating adjusting device.

Figure 8:
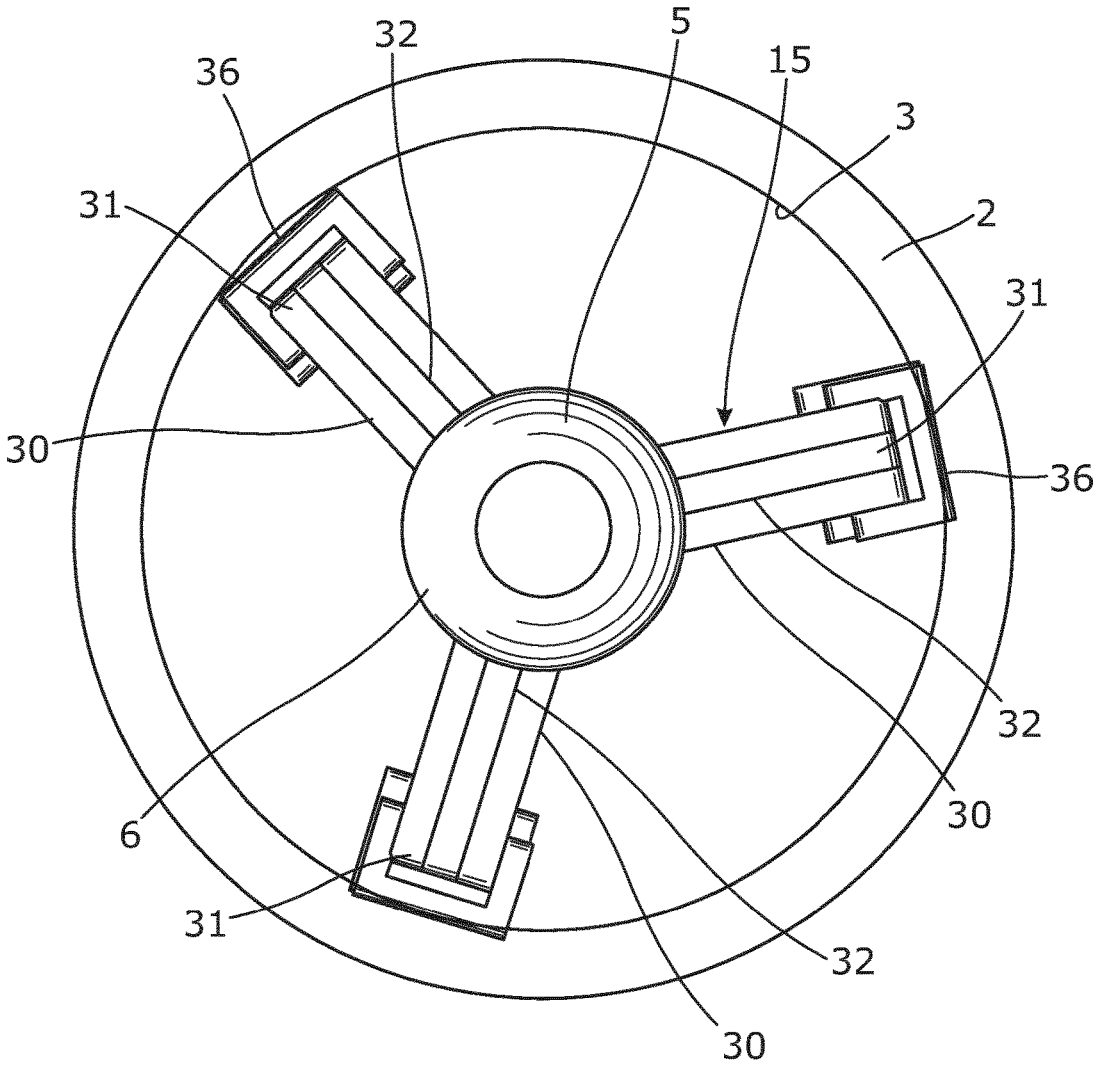
FIG. 8 shows an autonomous operating adjusting device arranged concentrically in the casing.
Figure 9:
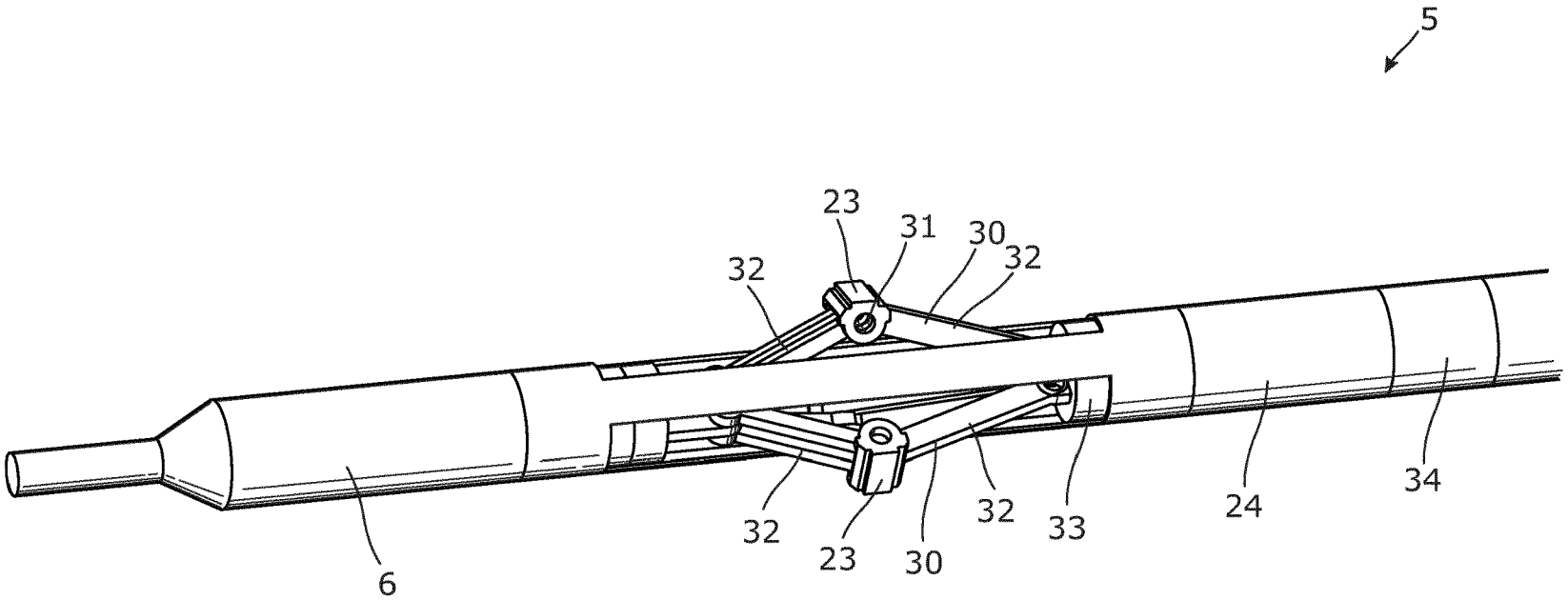
FIG. 9 shows another autonomous operating adjusting device.

In FIG. 3, the anchor means 23 are radially projectable from the body 6 by means of a spring or hydraulics. In FIGS. 8 and 9, the anchor means are three arms 30, each arm having two arm parts 32 pivoting around a pivot joint 31. The pivot joint 31 has an outer face capable of engaging the inner surface of the casing. The arm parts 32 pivot around the pivot joint for engaging or disengaging the inner surface of the casing by rotating a spindle engaging one end of the arms by a screw connection or by means of hydraulic pressure. Each autonomous operating adjusting device comprises a releasing means 33 (see FIG. 9) for releasing the anchor means above a predetermined value of pulling force. The releasing means 33 may be a shear pin or a shear disc. Upon retrieval of the autonomous operating adjusting device 5, a tool latches onto the fishing neck and pulls the autonomous operating adjusting device 5 until the predetermined pulling force is reached, shearing the shear pin or disc, and the anchor means release.

Figure 5:
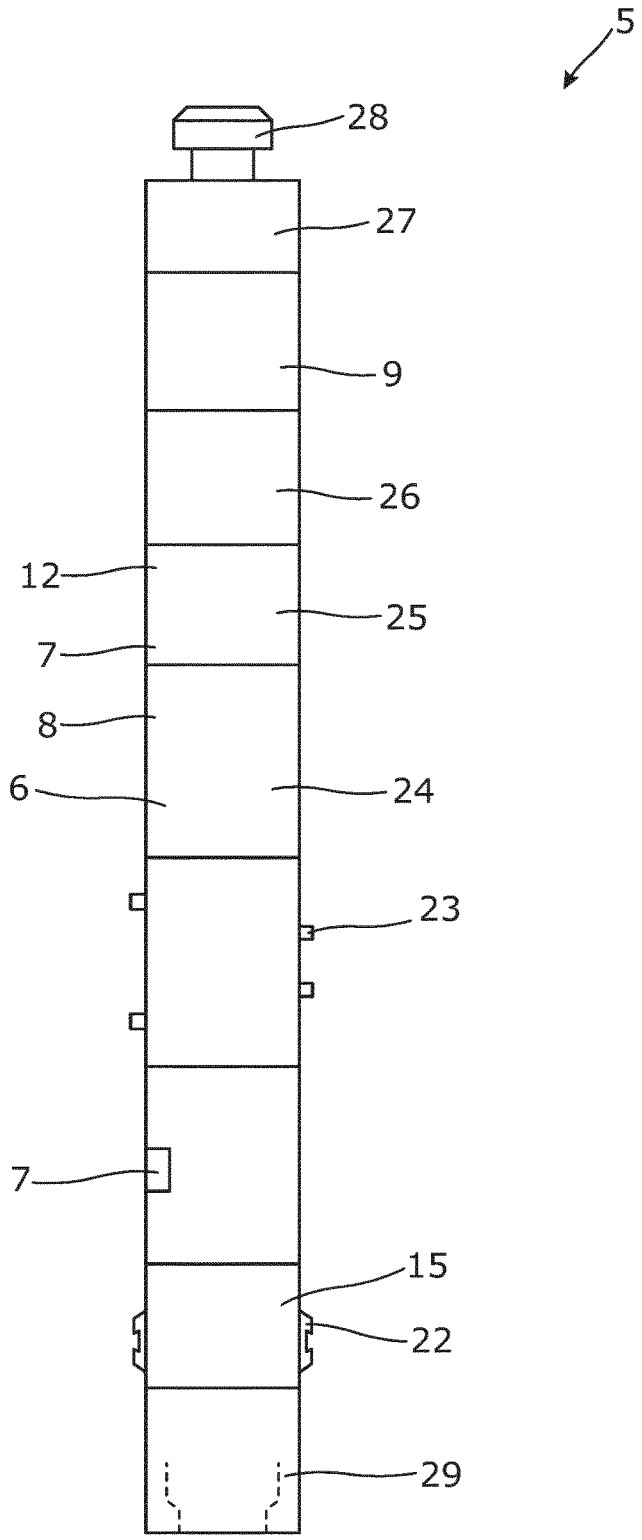
FIG. 5 shows another autonomous operating adjusting device.

As shown in FIG. 5, the autonomous operating adjusting device 5 comprises a fishing neck 28 in one end and a latch tool 29 in the other end for latching onto an autonomous operating adjusting device 5 arranged further down the well.

Figure 7:
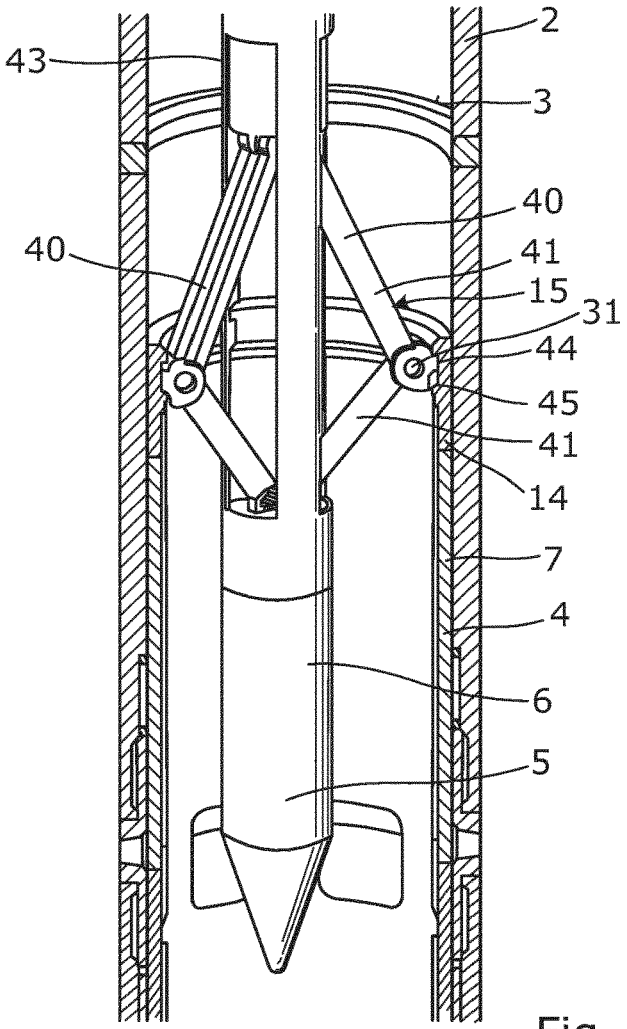
FIG. 7 shows a partly cross-sectional view of the downhole valve system of FIG. 6 seen along the casing.

In FIGS. 6 and 7, the operating means 15 of the autonomous operating adjusting device 5 comprises two arms 40, each arm having two arm parts 41 pivoting around a pivot joint 31. The pivot joint 31 has an outer face 44 capable of engaging the inner surface for the casing. The arm parts pivot around the pivot joint for engaging or disengaging the profile of the displaceable part 14 of the valve 4 by rotating a spindle engaging one end of the arms by means of a screw connection. Each autonomous operating adjusting device comprises a releasing means 43 for releasing the operating means 15 above a predetermined value of the pulling force. The releasing means 43 may be a shear pin or a shear disc. Upon retrieval of the autonomous operating adjusting device 5, a tool latches onto the fishing neck (see FIG. 5) and pulls the autonomous operating adjusting device 5 until the predetermined pulling force is reached, shearing the shear pin or disc, and the operating means 15 release.

FIG. 8 shows the operating means 15 of the autonomous operating adjusting device 5 seen along the central axis of the casing. The autonomous operating adjusting device 5 comprises three arms 30, each arm having two arm parts 32 (only one arm part visible of each arm). The arm parts 32 pivot around a pivot joint 31. The pivot joint 31 has an outer face 36 capable of engaging the inner surface 3 of the casing 2.

In FIG. 9, the stroking device 24 of the autonomous operating adjusting device 5 is a linear actuator which is operated by an electric motor 34 without the use of a pump. The linear motion can be achieved with a gear motor connected to a threaded spindle. The linear actuator is arranged in the body 6 of the autonomous operating adjusting device 5. The operating means comprises three arms 30 (only two visible) having arm parts 32. The pivot joint 31 has an outer face 36 capable of engaging the inner surface of the casing or a displaceable part (not shown).

FIG. 10 discloses another embodiment of a valve 4 in which the displaceable part is defined by three parts; a first sleeve 86 and a second sleeve 82, where the first sleeve being divided into a first sleeve part 87 and a second sleeve part 88.

The valve 4 comprises a tubular base part 73 having an axial axis 74 and being adapted to be mounted as part of the casing 2. The tubular base part 73 has a first opening 85 arranged opposite the borehole. The first sleeve 86 is arranged inside the tubular base part 73 and has a first sleeve part 87 and a second sleeve part 88 with a second opening 89. The first sleeve 86 is adapted to slide along the axial axis 74 to at least partly align the first opening 85 with the second opening 89 so that fluid communication may be provided between the borehole and an inside of the casing 2.

Figure 11:
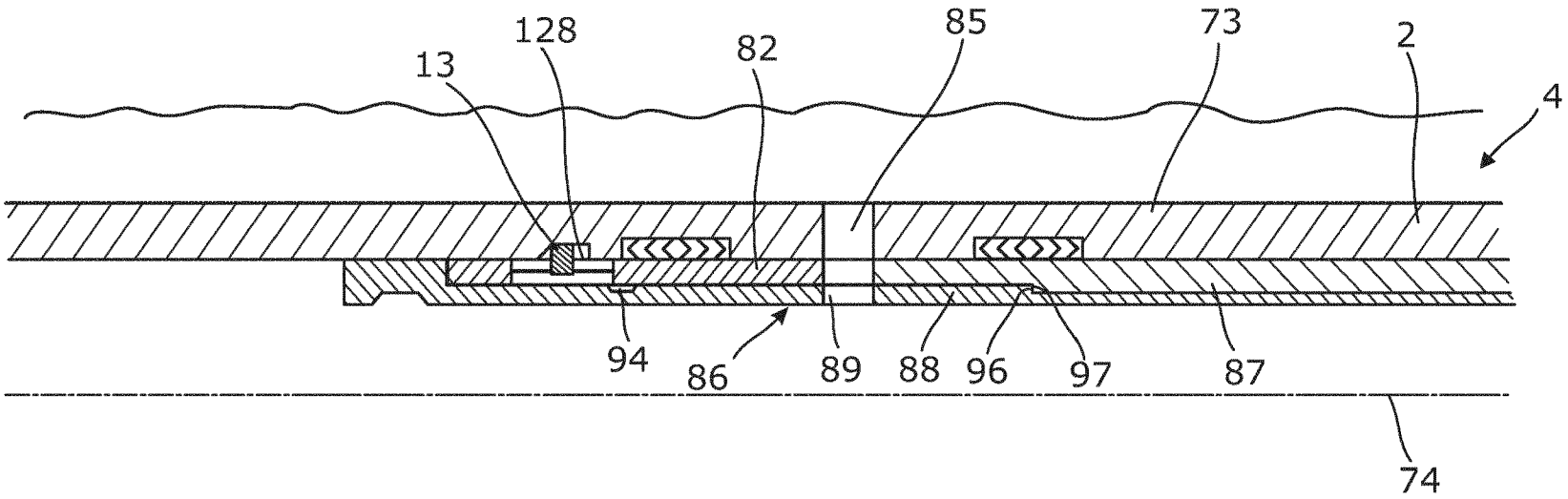
FIG. 11 shows the valve of FIG. 10 in an open position.

Furthermore, a second sleeve 82 is arranged at least partly between the second sleeve part 88 and the tubular base part 73, and an engagement element 13 is arranged for engaging an indentation 94 of the second sleeve part 88 in a first position, which is the position shown in FIG. 10. In the first position, the first and second openings are unaligned and the valve 4 is in its closed position in which no well fluid is allowed to flow into the casing. The engagement element 13 is furthermore adapted to disengage the indentation 94 of the second sleeve part 88 in a second position when the first and second sleeves 86, 82 have been slid along the axis 74 in relation to the tubular base part. The second, open position is shown in FIG. 11.

When the engagement element 13 is engaged in the indentation 94 of the second sleeve part 88, the second sleeve 82 will slide along the axial axis 74 together with the first sleeve 86 until the engagement element 13 disengages the indentation 94, enabling the first sleeve 86 to slide further along the axial axis 74 without the second sleeve 82 sliding along the axial axis.

When the valve 4 is in its closed position, the first and second sleeves abut each other, preventing scale or debris from precipitating as there is no opening therebetween to precipitate in. This eliminates the disadvantages of scales and other debris settling in the openings and thereby minimising or even closing off the flow possibilities through the openings entirely when these openings are aligned. This is due to the fact that the opening in the sleeve is not created until the first sleeve is moved away from the second sleeve.

In addition, the valve 4 also comprises a first sealing element 122 and a second sealing element 123, as shown in FIG. 10. The first sealing element 122 is arranged in a first circumferential groove 124 in the inner face of the tubular base part 73 on a first side of the first opening 85. The second sealing element 123 is arranged in a second circumferential groove 125 in the tubular base part 73 on a second side of the first opening 85, where the second side is opposite the first side. Preferably, the sealing elements 122, 123 are chevron seals.

The first sealing element 122 is arranged between the first sleeve part 87 and the tubular base part 73. The second sealing element 123 is arranged between the first sleeve part 87 and the tubular base part 73 in the first position, as shown in FIG. 10, and between the second sleeve 82 and the tubular base part 73 in the second position, as shown in FIG. 11. Due to the fact that the first sleeve and the second sleeve abut each other when passing the first and the second sealing elements, the risk of the sealing elements being damaged is minimised, and it is hence obtained that their sealing properties are maintained, since the opening is not created until the second sleeve has passed the second sealing element.

In the embodiment of FIG. 10, the first sleeve part 87 and the second sleeve part 88 are two separate elements. The first sleeve part 87 has a first thickness $t_{1,1}$ and a second thickness $t_{1,2}$, and the second thickness is larger than the first thickness. Between the first thickness and the second thickness, a first wall 95 is arranged. The first thickness is positioned closest to the second sleeve 82.

In the same manner, the second sleeve part 88 has a first thickness $t_{2,1}$ and a second thickness $t_{2,2}$, and the first thickness is larger than the second thickness. The second opening 89 is positioned in the part of the second sleeve part 88 having the first thickness $t_{2,1}$. Between the first thickness $t_{2,1}$ and the second thickness $t_{2,2}$ a second wall 96 is arranged. The first wall 95 and the second wall 96 are positioned opposite each other with a distance between them defining a cavity 97. The second sleeve part 88 is, in the shown embodiment, capable of sliding along the axial axis 74 independently of the first sleeve part 87 until the second wall 96 abuts the first wall.

Furthermore, the first sleeve part 87 has a first end 98 and a second end 99, and the second sleeve 82 has a first end 220 and a second end 221, the first end 98 of the first sleeve part 87 abutting the second end 21 of the second sleeve 82 in the first position, as shown in FIG. 10. Hereby, the second sleeve 82 may assist in sliding the first sleeve part 87 when the second sleeve part 88 is connected to the second sleeve 82 via the engagement element 13 and the second sleeve part 88 is moved along the axial axis 74.

In FIG. 10, the first sleeve part 87 abuts the second sleeve part 88, the first sleeve part 87 and the second sleeve part 88 yet still being slidable in relation to each other. The first sleeve part 87 is arranged between the second sleeve part 88 and the tubular base part 73.

The second sleeve 82 of FIG. 10 has a through-going bore 126 in which the engagement element 13 is arranged. The engagement element 13 has a length which is longer than a thickness of the second sleeve 82. The through-going bore 126 is considerably larger than the width of the engagement element 13, meaning that a spring 127 may be arranged in connection with the engagement element 13. The spring 127 exerts a force on the engagement element 13 towards the tubular base part 73, whereby the engagement element 13 is spring-loaded when engaging the indentation 94 in the second sleeve part 88 and will disengage the indentation 94 as soon as it is possible for the engagement element 13 to move in a radial direction away from the axial axis 74. In FIG. 10, the spring 127 is a leaf spring, however, other springs may be used, e.g. a helical spring arranged around the engagement element 13.

The tubular base part 73 has a recess 128 arranged opposite the second sleeve 82. The recess 128 is adapted to receive the engagement element 13 at the second position, as shown in FIG. 11. Thus, when the sleeves 86, 82 are slid along the axial axis 74, the engagement element 13 is maintained in engagement with the indentation 94 until it reaches the recess 128, causing the spring-loaded engagement element 13 to be forced in the radial direction, hence disengaging the indentation 94 by engaging the recess 128.

Furthermore, the second sleeve part 88 has an inner face 129 and at least one groove 130 in the inner face 129 for engagement with an operating means, such as a key (not shown). In FIG. 10, the second sleeve part 88 has a first end 131 and a second end 132, and a groove 130 is arranged in each end. At the first end 131 of the second sleeve part 88, an inside groove 133 is arranged between the second sleeve 82 and the first end 131, enabling the second sleeve part 88 to move in relation to the second sleeve 82 when the engagement element 13 has disengaged the indentation 94 in the second sleeve part 88.

In FIG. 11, the first sleeve 86 of the valve 4 is shown in an open position of the valve 4 where the first and second openings are aligned.

Figure 12:
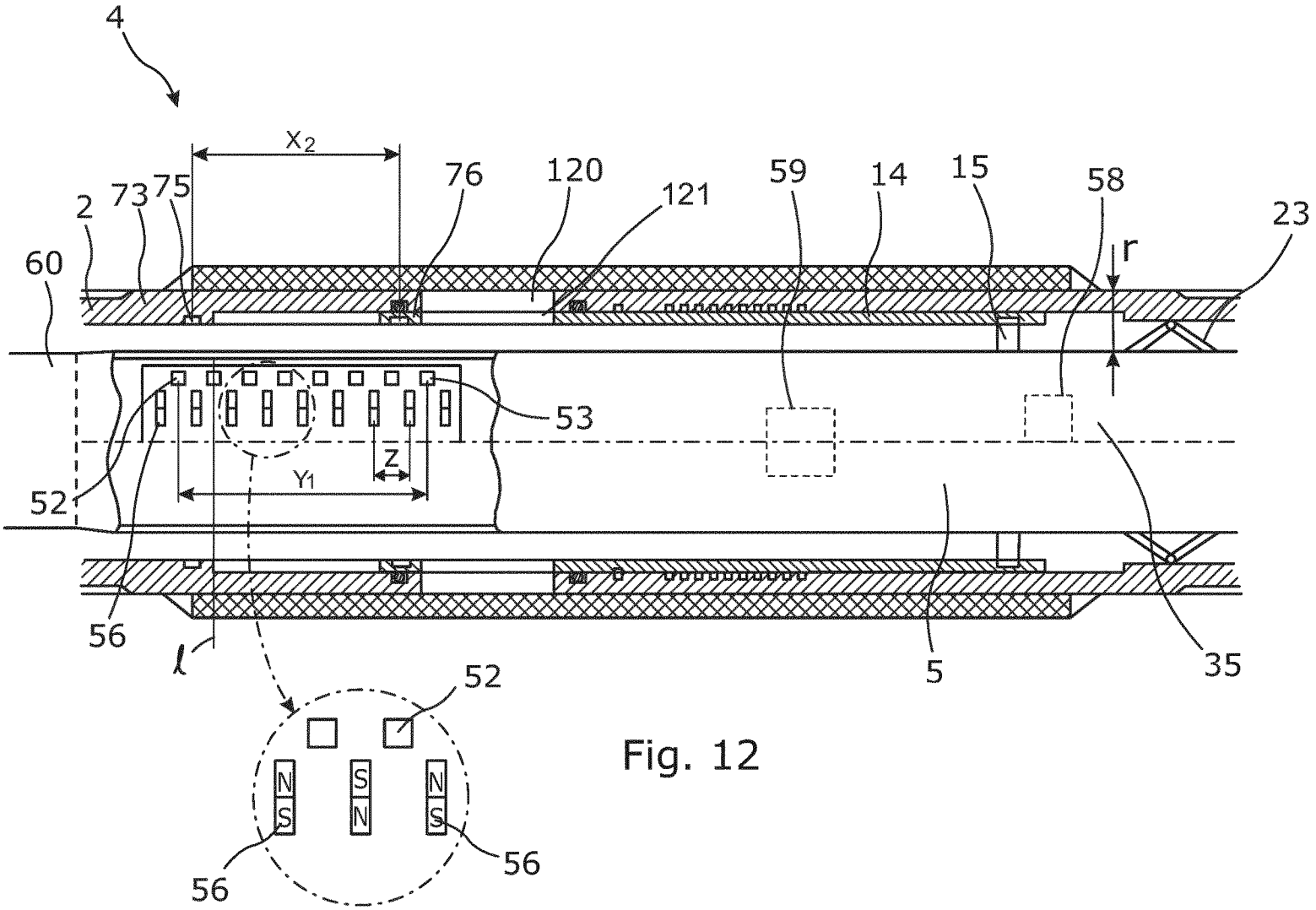
FIG. 12 shows a partly cross-sectional view of a positioning detection unit for determining the position of the displaceable part of the valve.

As shown in FIG. 12, the autonomous operating adjusting device 5 comprises a positioning detection unit 35 for determining the position of the displaceable part. FIG. 12 discloses a valve 4 of a downhole valve system comprising a casing 2, the valve 4 and a positioning detection unit 35 being arranged in the autonomous operating adjusting device 5 for detecting a marker distance between a first marker 75 of a tubular base part 73 of the valve 4 and a second marker 76 of the displaceable part 14. As the displaceable part 14 is moved in relation to the tubular base part 73, the marker distance changes. The positioning detection unit 35 detects the position of the markers simultaneously, and the detection thereby does not rely on time. The positioning detection unit 35 in this embodiment comprises eight detectors.

As can be seen from FIG. 12, the positioning detection unit 35 comprises intermediate detectors arranged between the first and second detectors 52, 53. The common detector range is the common detection range for all eight detectors. The detectors are magnetometers, and the positioning detection unit 35 further comprises a plurality of magnets 56. Each magnet has a north pole and a south pole, as shown in the enlarged view of FIG. 12, and two adjacent magnets are arranged in such a way that repelling poles are arranged in opposite directions. The detectors are arranged along a line I arranged between two adjacent magnets so that the magnetic field lines are substantially linear through the magnetometers. The detectors are arranged with a predetermined distance z between them so that when two detectors detect the markers, the position of the displaceable part is determined. Along this line I, the magnetic field lines are substantially parallel to the axial extension of the autonomous operating adjusting device 5, and when the magnets pass the markers, the markers are magnetised and divert the magnetic field. The detectors detect this diversion, and based on the detected diversion, the position of the markers can be determined in that the distance between the detectors is known. Thus, the marker distance is determined by simultaneous detection of the first and second markers by two separate detectors, and since the distance between the two detectors having detected the first or the second marker is known, the marker distance can be determined. When knowing the marker distance, the position of the displaceable part 14 in relation to the tubular base part 73 is known. By knowing the position of the displaceable part 14 in relation to the tubular base part 73, information of how much the openings 120, 121 overlap is also known. In another embodiment, the magnetometers measure the change in direction or magnitude of the magnetic field.

In FIG. 12, the markers are made of a magnetisable material, and the displaceable part 14 and the tubular base part 73 are made of a non-magnetisable material. The markers may also be made of a ferromagnetic material, and the detectors may be magnetometers. The detector range is larger than the marker distance $X_2$ in the fully open position of the completion component. The common detection range is larger than the second marker distance $X_2$, and thus, the markers can be detected simultaneously by the positioning detection unit 35.

The marker may also be a geometrical pattern provided by varying the thickness of the base part and the displaceable part, respectively. The detectors may be readers, such as RFID readers for reading an RFID tag being the marker, Geiger-counters for reading an x-ray source being the marker or magnetometers. The first marker may be different from the second marker, and the first detector may also be different from the second detector.

The valve 4 may be a sliding sleeve, as shown in FIG. 12 where the displaceable part 14 is the slidable sleeve. A screen surrounds the sleeve.

In FIG. 12, the autonomous operating adjusting device 5 comprises anchoring means 23 and an operating means 15. The positioning detection unit 35 comprises a communication unit 60.

It will be understood that the flow of fluid may be an inflow of fluid from a formation, but likewise the system according to the invention may be a system for controlling the injection of a fluid to the formation. Such injection to the formation may be exerted during hydraulic fracking.

A stroking device is a device providing an axial force. The stroking device is operated by an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or production casing is meant any kind of pipe, tubing, tubular, liner, string etc. used downhole in relation to oil or natural gas production.

In the event that the autonomous operating adjusting device is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole valve system for controlling a flow of a fluid to and from a formation, comprising:

a casing having an inner surface, an outer diameter and an inner diameter, and a cross section defined by the inner diameter, the casing comprising:

a plurality of valves arranged spaced apart from each other for controlling the flow of the fluid to and from the formation through the casing, and a plurality of autonomous operating adjusting devices each controlling one of the plurality of valves and each autonomous operating adjusting device comprising a body having an outer body diameter and a body cross section, each said autonomous operating adjusting device being fastened inside the casing proximate a respective one of the valves, each said autonomous operating adjustment device being configured to adjust flow through the respective valve whilst at the same time allowing the fluid to flow between the outer body diameter of the body of the autonomous operating adjusting device and the inner surface the casing, wherein the plurality of autonomous operating adjustment devices are configured to control the plurality of valves in order to adjust a mixture of the flow of fluid from the formation, the mixture being made up of flow from at least two independently controlled ones of the plurality of valves.

2. A downhole valve system according to claim 1, wherein the cross section of the body of the autonomous operating adjusting device is less than 50% of the cross section of the casing defined by the inner diameter.

3. A downhole valve system according to claim 1, wherein the body of the autonomous operating adjusting device is arranged concentrically with the casing.

4. A downhole valve system according to claim 1, wherein the body of the autonomous operating adjusting device has a first portion that abuts the inner surface of the casing and a second portion that is spaced away from the inner surface of the casing to allow flow whilst allowing selective control of the valve.

5. A downhole valve system according to claim 1, wherein the system comprises a sensor for measuring a condition of the fluid, including temperature, pressure, water out, density or flow rate.

6. A downhole valve system according to claim 5, wherein a sensor is arranged in each autonomous operating adjusting device.

7. A downhole valve system according to claim 5, wherein each autonomous operating adjusting device comprises a processor for computing measured sensor data for controlling the valve.

8. A downhole valve system according to claim 1, wherein each autonomous operating adjusting device comprises a communication means.

9. A downhole valve system according to claim 1, wherein the plurality of autonomous operating adjusting devices are positioned in succession of each other in the casing.

10. A downhole valve system according to claim 1, wherein each autonomous operating adjusting device comprises a dispatching means for dispatching an information device.

11. A downhole valve system according to claim 1, wherein each autonomous operating adjusting device comprises a pressure pulse communication means for receiving signals from surface and/or another autonomous operating adjusting device.

12. A downhole valve system according to claim 1, wherein each valve comprises a displaceable part for adjusting the inflow of fluid.

13. Method for controlling a flow of fluid by controlling a plurality of valves in a downhole valve system according to claim 1, the method comprising:

arranging each autonomous operating adjusting device opposite one of the valves, fastening the autonomous operating adjusting device to the inner surface of the casing, measuring a condition of the fluid, and controlling the valve based on the measured condition of the fluid.

14. Method for controlling an flow of fluid according to claim 13, wherein arranging each autonomous operating adjusting device is performed by a wireline or a downhole drive, and wherein the method further comprises releasing the autonomous operating adjusting device from the wireline or downhole drive.

15. Method for controlling a flow of fluid according to claim 13, wherein the method further comprises adjusting a position of a displaceable part of the valve.

16. A downhole valve system according to claim 1, wherein each autonomous operation adjustment device includes an anchor to fasten to the inside surface of the casing.

17. A downhole valve system according to claim 16, wherein each autonomous operating adjustment device is fastened to the inside surface whilst allowing the fluid to flow between the outer body diameter of the body and the inner surface of the casing.

* * * * *